US011484762B1

(12) United States Patent
Rivera

(10) Patent No.: US 11,484,762 B1
(45) Date of Patent: Nov. 1, 2022

(54) TRAINING DEVICE

(71) Applicant: Mark Christopher Rivera, Dry Ridge, KY (US)

(72) Inventor: Mark Christopher Rivera, Dry Ridge, KY (US)

(73) Assignee: Mark Rivera, Union, KY (US)

( * ) Notice: Subject to any disclaimer, the term of this patent is extended or adjusted under 35 U.S.C. 154(b) by 0 days.

(21) Appl. No.: 17/305,479

(22) Filed: Jul. 8, 2021

(51) Int. Cl.
*A63B 69/36* (2006.01)
*A63B 37/00* (2006.01)
*A63B 102/32* (2015.01)

(52) U.S. Cl.
CPC ..... *A63B 69/3688* (2013.01); *A63B 37/0083* (2013.01); *A63B 2102/32* (2015.10)

(58) Field of Classification Search
CPC ..... A63B 69/3688; A63B 37/0083; A63B 2102/32
USPC ..... 473/113, 200, 253, 280, 355, 375, 377, 473/570, 594
See application file for complete search history.

(56) References Cited

U.S. PATENT DOCUMENTS 737,031 A * 8/1903 Short
1,120,757 A * 12/1914 Steinberger ..... 473/594
2,219,154 A * 10/1940 Wahlberg ..... A63F 9/0415 446/458
2,504,650 A * 4/1950 Chessrown ..... A63B 43/00 428/11
2,859,968 A * 11/1958 Modica, Jr. ..... A63B 43/04 473/594
3,954,269 A * 5/1976 Brittingham ..... A63F 9/0415 273/146
4,194,737 A * 3/1980 Farmer ..... A63H 33/005 473/570
4,441,716 A 4/1984 Chen
4,664,387 A 5/1987 Tardiff
4,940,238 A 7/1990 Bradley
5,013,046 A 5/1991 Koch
5,351,650 A * 10/1994 Graves ..... A01K 15/025 473/594
5,885,165 A 3/1999 Krause
5,897,117 A * 4/1999 Wei ..... A63B 43/00 473/571
6,729,969 B2 5/2004 Fox
6,739,980 B2 5/2004 Scott et al.
6,755,753 B2 * 6/2004 Nesbitt ..... A63B 21/4035 473/375
6,832,423 B1 12/2004 Villacorta
7,371,186 B2 5/2008 Rutherford
7,416,493 B2 8/2008 Carter
8,403,768 B2 3/2013 Aittola
(Continued)

*Primary Examiner* — Nini F Legesse

(57) ABSTRACT

A putting training device having the same size and feel of a standard golf ball yet adapted to exaggeratedly deviate from an expected line of action when mishit relative to a predefined line of action. The putting training device may have one or more inner cavities wherein an inner spherical object rolls along a tracked, concentric first curvature when the putting training device is struck with a putter accurately along the predefined line of action, and wherein the inner spherical object moves to a side portion of the one or more cavities upon the putting training device being mishit, resulting in the exaggerated deviation that affords the user a visual feedback they can learn from and recalibrate their future putts to.

19 Claims, 4 Drawing Sheets

(56) References Cited

U.S. PATENT DOCUMENTS

| | | | | |
|---|---|---|---|---|
| 8,695,979 | B1 * | 4/2014 | Seldin | G09B 21/001 446/419 |
| 9,782,656 | B2 | 10/2017 | Burke | |
| 9,925,421 | B2 | 3/2018 | Kim | |
| 2005/0037868 | A1 | 2/2005 | Tamura | |
| 2006/0293113 | A1 | 12/2006 | Pelz | |
| 2007/0207874 | A1 | 9/2007 | Klein | |
| 2010/0124999 | A1 | 5/2010 | Wills | |
| 2014/0080620 | A1 | 3/2014 | Nagi | |

* cited by examiner

TRAINING DEVICE

BACKGROUND OF THE INVENTION

The present invention relates to ball-related games and, more particularly, a golf putting training device for the game of golf.

During a ball-related game, manipulating the ball to do what a participant intends is very frequently the greatest skill-based challenge in such ball-related games. For instance, a skilled, accurate golf putting stroke is difficult to learn, achieve, and maintain. An accurate putting stroke can be achieved when the putter's face angles and swing path are moving down the intended target line in line with a circumference of the golf ball, within a narrow margin of error.

When practicing putting with standard golf balls, it can be difficult or impossible to determine the difference between the action of a well struck ball and a poorly, or even slightly poorly struck ball, and determining what was incorrect about the stroke.

Current putting training devices do not provide sufficient feedback regarding the accuracy of the putting stroke. Additionally, some putting training devices are not practical for use in all potential practice environments (e.g., at the office).

As can be seen, there is a need for a golf putting training device that provides immediate feedback/confirmation of the putting stroke, and is golf-ball sized, making it extremely portable, handy and discrete to use.

In short, the present invention is a golf ball or a spherical object that provides putting stroke feedback in a practice setting. Specifically, the present invention is dimensioned and adapted to roll favorably when an accurate putting stroke is applied, while also adapted to react in an exaggerated manner and/or deviated path when struck sub-optimally. As a result, the specific action and path of the ball upon a given strike can be analyzed to determine if and, if so, what type of improper stroke was applied, as it pertains to swing path and putter face position/angles at impact relative to the prime circumference. Moreover, the practice ball is very sensitive to improper strikes, with a relatively small window of forgiveness, and thus works as an effective training and practice device to hone the putting skill.

The design geometries of the ball-device are such that multiple versions of the same basic product can be produced with different inherent sensitivities for various skill levels and environments. The present invention can be used discretely in putting training, practice, and event warmup to help identify putting stroke issues quickly and hone-in on a more optimal stroke. In other words, though current putting training devices work fine, none are quite as simple, effective, portable, and practical as the present invention.

Additionally, it is understood that the present invention is not limited to the game of golf, and so the device contemplated and disclosed herein could be used as a training device in any endeavor where training the application of a force on an object so that the object rolls or travels along an intended line of action would be within the ambit of the invention concept claimed herein. As a result, the spherical body contemplated here could be any finite size greater than zero millimeters, and the corresponding one or more cavities and single shiftable mass similarly sized to function in accordance with the disclosure herein.

SUMMARY OF THE INVENTION

In one aspect of the present invention, a training device includes a spherical body configured to deviate from an expected line of action when a force is applied obliquely relative to a prime circumference.

In another aspect of the present invention, the above training device further includes the following: a single shiftable mass within the spherical body; one or more cavities within the spherical body, wherein a first curvature is symmetrically disposed relative to the prime circumference; and the first curvature dimensioned so that the single shiftable mass rides there along when the applied force is approximately in line with the prime circumference; and two side cavities of the one or more cavities, one side cavity disposed on either side of the first curvature within the spherical body, each side cavity communicating with a void defined by the first curvature; and two raised lips, each raised lip defined at a communicative interface of the void of the first curvature and each of the two side cavities, respectively, wherein a distal end of one or more of the two raised lips are a first distance from an axis of rotation normal to the prime circumference, wherein the first distance is less than a radius of the first curvature, wherein the first distance is less than the radius of the first curvature for a side distance defined as extending from each raised lip toward an exterior of the spherical body, and wherein the side distance is at least a diameter of the single shiftable mass; and a prime circumferential indicium along an outer surface of the spherical object body, wherein the spherical body has a mass and outer circumference approximately similar to a regulation golf ball, wherein the applied force is imparted by a golf putter and the expected line of action is along a supporting surface, and wherein the single shiftable mass is spherical, wherein a first curvature defines the first cavity and thus a track for the single shiftable mass rides along when the applied force is substantially in line with the prime circumference, wherein substantially is understood to be plus or minus five degrees.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a putting training device having the same size and feel of a standard golf ball yet adapted to exaggeratedly deviate from the expected line of action when mishit relative to a predefined line of action. The putting training device may have one or more inner cavities wherein an inner spherical object rolls along a tracked, concentric first curvature when the putting training device is struck with a putter accurately along the predefined line of action, and wherein the inner spherical object moves to a side portion of the one or more cavities upon the putting training device being mishit, resulting in the exaggerated deviation that affords the user a visual feedback they can learn from and recalibrate their future putts.

Referring now to FIGS. 1 through 10, the present invention may include a putting training device 100. The putting training device 100 may have a spherical body 10 possessing a hemispherical balance (at least relative to a prime circumference).

As used herein, spherical is a reference to a shape like a sphere or geometrical object in three-dimensional space that is the surface of a ball, wherein the object or ball may have a non-uniform surface, such as a golf ball may have dimples along its surface. Spherical may be any sort of circular shape which can roll straight to a target.

Figure 1:
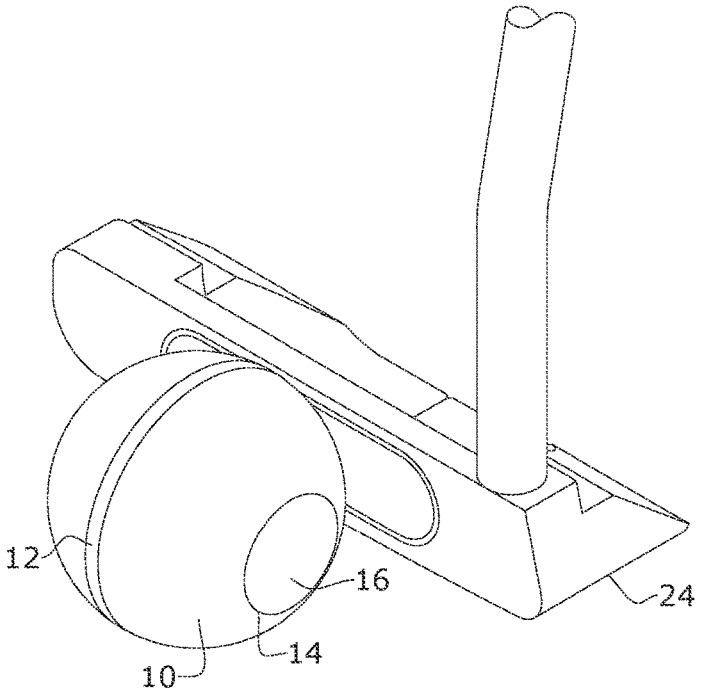
FIG. 1 is a perspective view of an exemplary embodiment of the present invention, shown in use.
Figure 2:
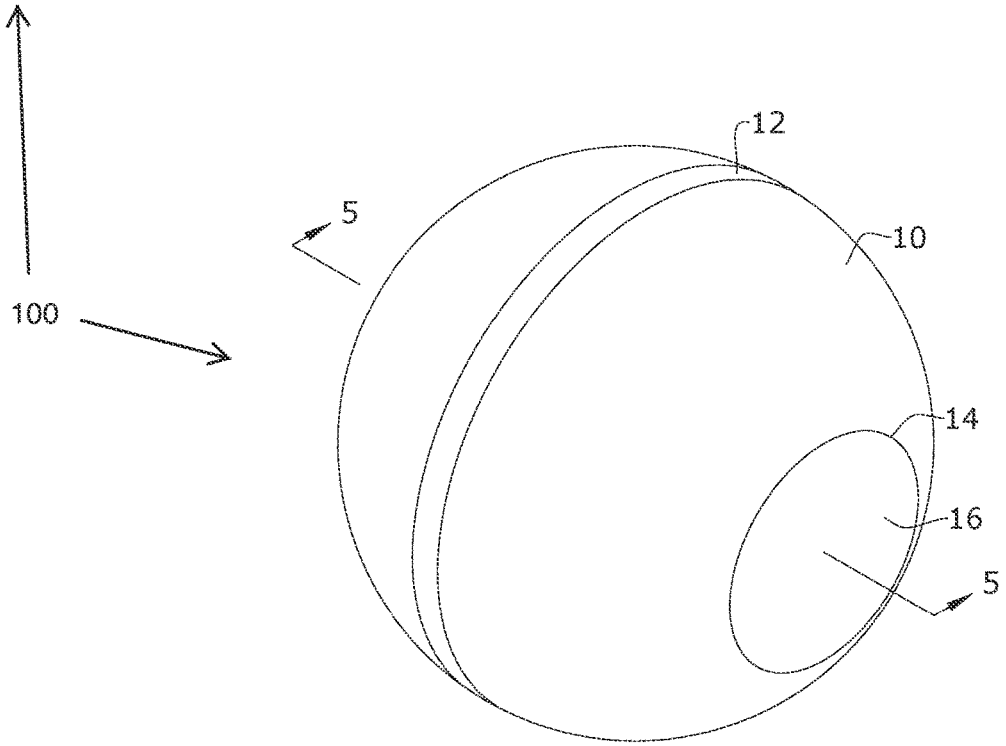
FIG. 2 is a perspective view of an exemplary embodiment of the present invention.
Figure 3:
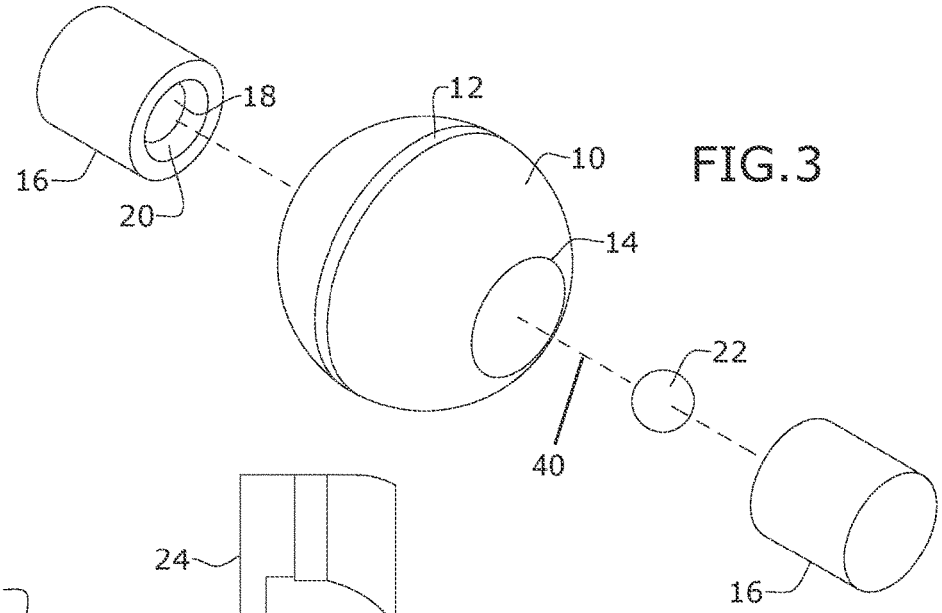
FIG. 3 is an exploded perspective view of an exemplary embodiment of the present invention.
Figure 4:
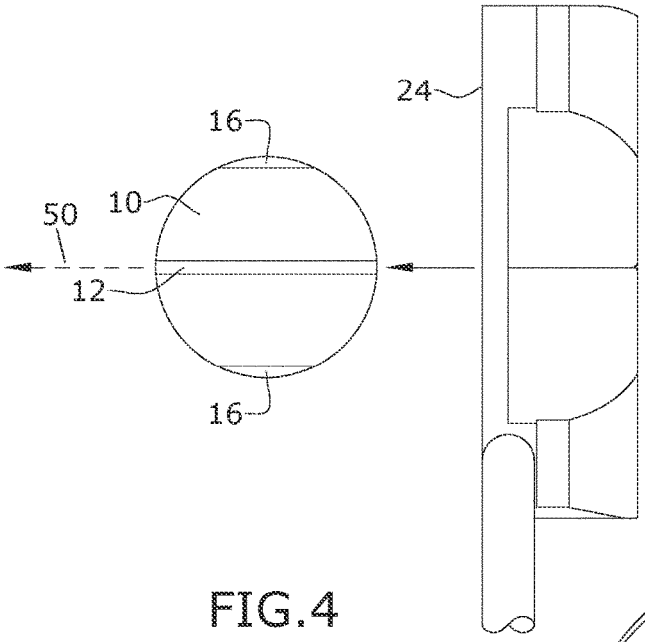
FIG. 4 is a top plan view of an exemplary embodiment of the present invention, shown in use in an aligned condition.
Figure 5:
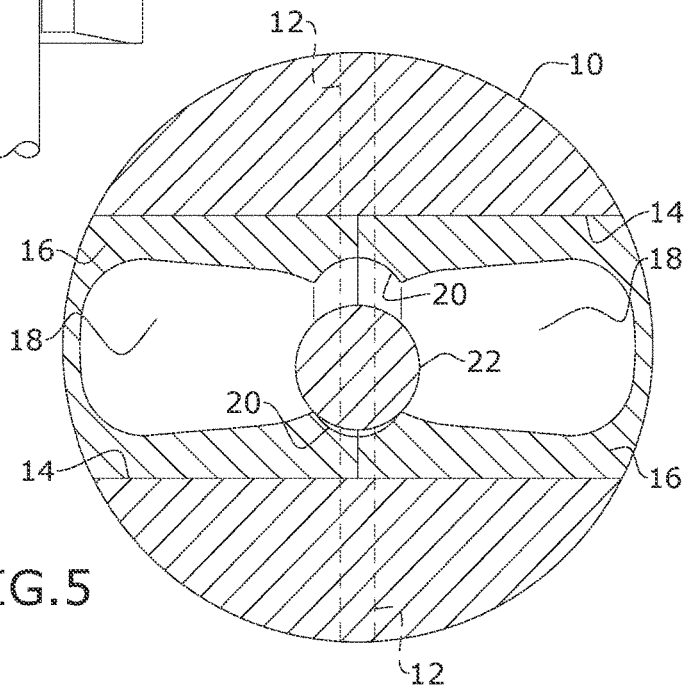
FIG. 5 is a section view of an exemplary embodiment of the present invention, taken along line 5-5 in FIG. 2, shown in the aligned condition.
Figure 6:
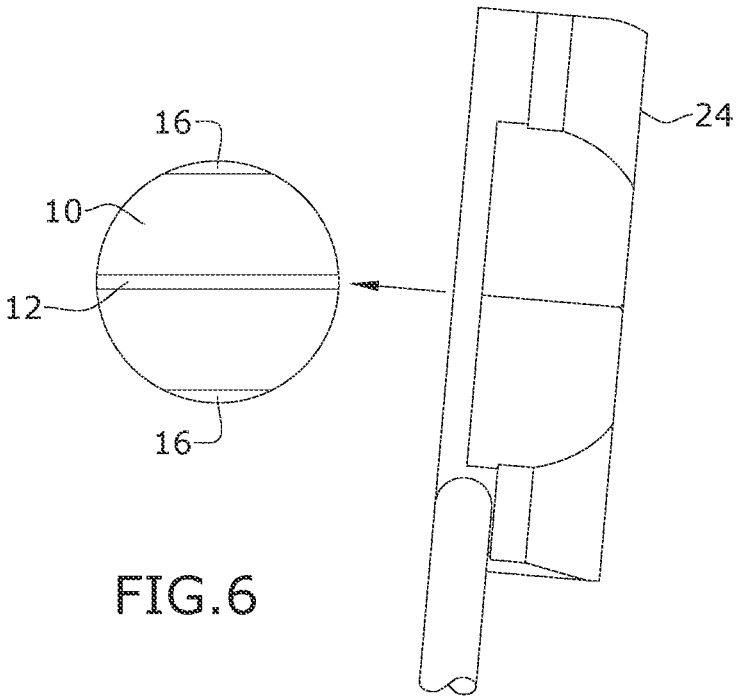
FIG. 6 is a top plan view of an exemplary embodiment of the present invention, shown in use in a misaligned condition.
Figure 7:
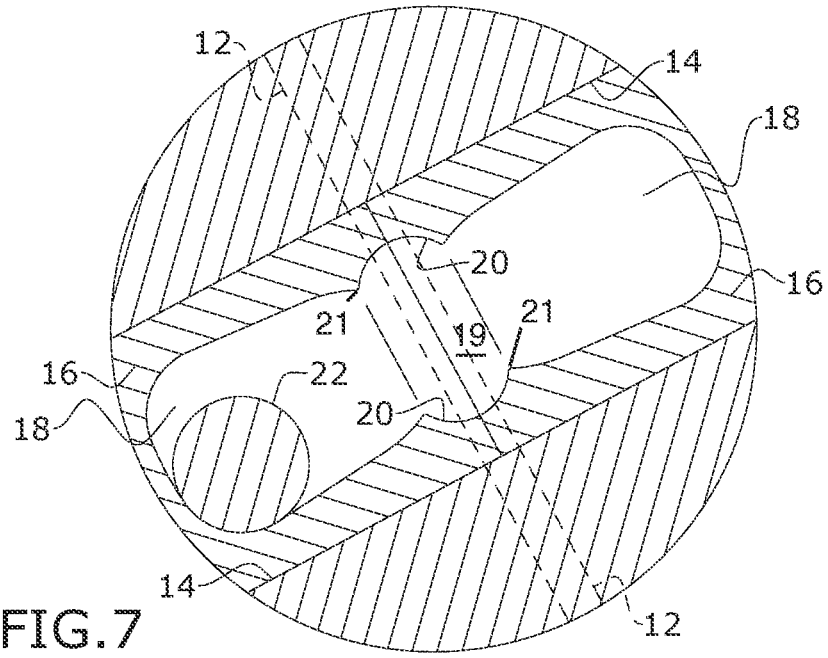
FIG. 7 is a section view of an exemplary embodiment of the present invention, similar to FIG. 5, through shown in the misaligned condition.
Figure 8:
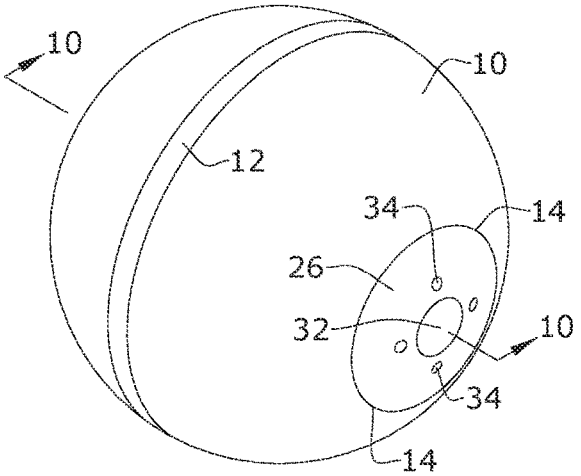
FIG. 8 is a perspective view of an exemplary embodiment of the present invention.
Figure 9:
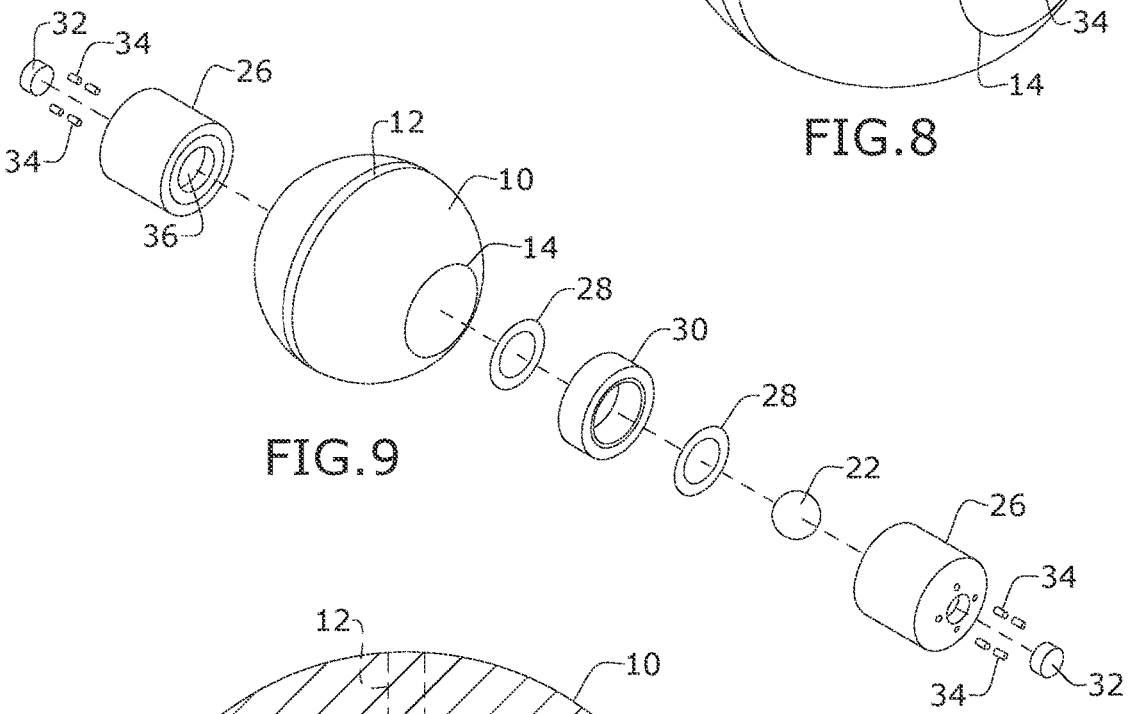
FIG. 9 is an exploded perspective view of an exemplary embodiment of the present invention.
Figure 10:
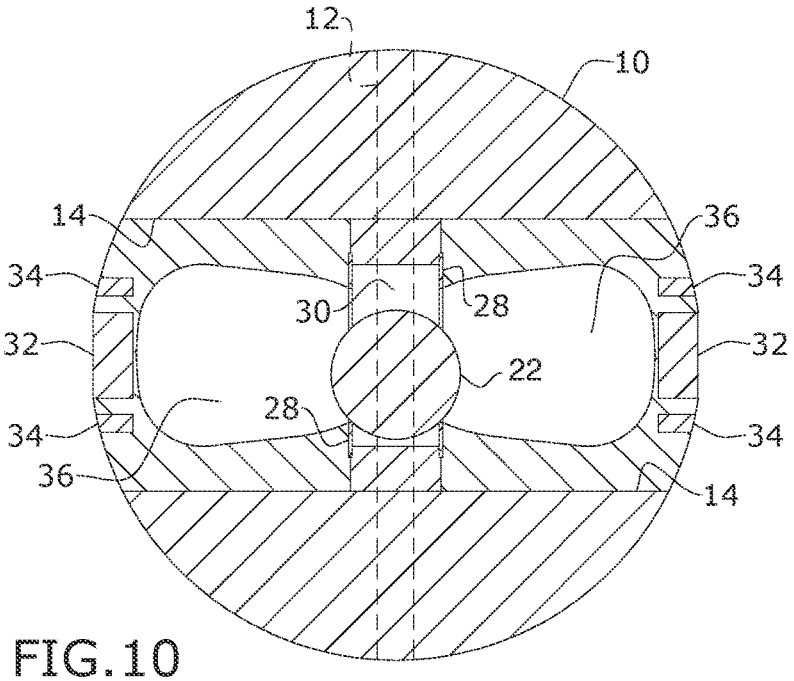
FIG. 10 is a section view of an exemplary embodiment of the present invention, taken along line 10-10 in FIG. 8, shown in the aligned condition.

As used herein, the prime circumference is the perimeter of the spherical body 10 that corresponds with the expected line of action or predefined line of action 50 along said perimeter if the putting training device 100 were urged to roll along an intended roll or rotational axis; for instance, when the putting training device 100 were properly struck with a putter along a supporting surface for achieving the predefined line of action 50, as illustrated in FIG. 4.

The spherical body 10 defines one or more internal cavities. In one embodiment, a first cavity 19 having hemispherical symmetry (relative to the prime circumference) may be defined by a first curvature 20 that is a function of a rotational axis 40 (sometimes referred to as the intended axis of rotation) that is perpendicular relative to the prime circumference. The first curvature 20 may be defined by a uniform first radius about the rotational axis 40 for 360-degrees, though not necessarily so for some embodiments. The first curvature 20 may be defined as a radial track defining the first cavity 19. It should be understood that the first curvature 20 may be discontinuous (i.e., not continuous along the 360-degrees of the first cavity 19.

A second cavity 18 and a third cavity 18 (or two side cavities 18) may be on opposing sides of the first cavity 19, respectively. The second and third cavities 18 may be mirror images of each other about the prime circumference. The first cavity 19 and the second and third cavities 18 (fluidly) communicate with each other. As a result, raised lips 21 may be defined at each discontinuity of the first curvature 20 as imposed by the communicative interface (at the cross section thereof) with the second and third cavities 18, respectively. Relative to the rotational axis 40 the raised lips 21 may be the closest solidity thereto within a distance defined by a diameter of an inner spherical object 22.

The inner spherical object 22 is dimensioned to roll between the cavities 19 and 18 may be provided. The first curvature 20 and the raised lips 21 are dimensioned and adapted to guide and channel the inner spherical object 22 along the first curvature 20 as long as the spherical body 10 rotates approximately about the rotational axis 40; or, in other words, when the spherical body 10 rolls approximately along the prime circumference. As the first curvature 20 may be concentric with the spherical body 10, any angular momentum in a direction oblique to the intended rotational axis 40 may be conserved when the spherical body 10 rolls along the prime circumference about the rotational axis 40, as the inner spherical object 22 rolls along the first curvature 20.

When the spherical body 10 rolls, however, along a different axis of rotation too deviant from the axis of rotation 40 then the raised lips 21 will not be able to keep the inner spherical object 22 on track along the first curvature 20 and the inner spherical object 22 will ride up and over one of the raised lips 21 and into the adjacent second or third cavity 18.

The result of the inner spherical object 22 jumping the track, so to speak, and rolling into one of the side cavities 18, in turn, shifts the center of gravity of the spherical body 10 relative to the initial rotation axis. This causes a dramatic change in the angular momentum and pulls the spherical body 10 considerably off-path, in the direction that the inner spherical object 22 and the side cavity 18 it fell into. In other words, the putting training device 100 reacts in an exaggerated manner and/or deviates from the expected path, thereby indicating that the spherical body 10 was struck sub-optimally—e.g., the face angle of the putter 24 and/or its swing path were not moving down the target line normal to the prime circumference of the spherical body 10, within the narrow margin of error. Accordingly, a user working on their putting stroke will notice this visual feedback as an indication of a sub-optimal putting stroke and/or striking angle.

The spherical body 10 may be the same diameter and weight as a regulation golf ball through any suitable material to effectuate those physical properties as well as being durable to take repeated impact forces while supporting the up to three cavities. A regulation golf ball has a mass no more than 1.620 oz (45.93 grams), has a diameter not less than 1.680 in (42.67 mm). As mentioned previously, the spherical body 10 may be approximately 42.67 mm in diameter and a mass of approximately 45.93 grams; though in other embodiments, the spherical body 10 may have a diameter and mass one-hundredth of that or one hundred times that.

The spherical body 10 could be made from a pre-existing golf ball hollowed out and inserts 16 added in the coring through-holes 14, thereby providing the additional mass to accommodate for the hollowing out. In this embodiment, the inserts 16 would provide/define the cavities 18 and 19. In other embodiments, each insert 26 may include arcuate fasteners 28 (such as but not limited to a washer) and a center ring 30 that defines the raised lips 21 and first curvature 20, respectively, while the remaining portions of the insert define the side cavity 36. In other embodiment, the inserts 26 may include at least one power source 32 (such as a battery), and a light source 34 (such as but not limited to LED lights).

In certain embodiment, where there is considered one inner cavity, the axially positioned inner cavity may be shaped such that the three main areas of the void exist, separated by two apertures slightly larger in diameter than the inner spherical object 22. The center area is shaped such that the inner spherical object 22 will stay positioned and roll in this center area if the ball is struck and rolled in a direction perpendicular to the axis of the inner cavity, allowing the inner spherical object 22 to roll straight to the target. The other two side areas of the inner cavity may be identically shaped and positioned at either end of the void.

Prior to putting the putting training device 100, the user carefully and precisely tilts the ball, rolling the inner spherical object through the length of the void until it rests in the center area of the inner cavity before placing the ball on the ground for putting. The user may also position the putting training device 100 such that the void axis is parallel to the ground, and perpendicular to the putting target.

A prime circumferential indicium 12, such as but not limited to an alignment stripe on the spherical body 10 positioned on the prime circumference (a perimeter perpendicular to the optimal axis of rotation 40) helps the user align the putting training device 100 to the target for proper operation, thereby allowing visual feedback as the putting training device 100 rolls. When the putting training device 100 is struck improperly and outside of its margin of error, the inner spherical object 22 can escape from the center area of the void and fall through one of the apertures and into the left or right outer areas. Once inner spherical object 22 falls into an outer area, the center of gravity relative to the roll axis changes dramatically and pulls the putting training device 100 considerably off-path, in the direction of the inner spherical object 22 fell into the outer area of the void. And the prime circumferential indicium 12 makes this visual feedback all the more visible.

A method of making the present invention may include the following. The spherical body 10 could be a standard golf ball modified with a cylinder shape void, or a specialty ball specifically made for the purpose. The golf ball could be fitted with a single or plurality of inserts 16 that fill the cylinder void and make up the profiled void internally. This separate piece could be comprised of two identical inserts 16/26 that meet in the center of the golf ball, trapping the inner spherical object 22 within the void. This separate piece could alternatively be made as a single piece/insert, with the inner spherical object 22 being installed and trapped inside during manufacture. This separate piece could be made from any high finish capable materials suited for desired operation. The inner spherical object 22 could be made of any material denser than the spherical body 10, as needed for desired operation. The inner spherical object 22 may have a finish that is smooth/polished as in standard ball bearings. The resultant total mass of the assembled ball would be roughly the same as a standard ball to achieve similar "feel" and roll distance when striking with a putter, perhaps slightly lower total mass than standard to account for the inner spherical object 22 being loose within, and the effect that has on the "feel" and roll distance.

Multiple ball versions with varied sized and profiled voids and/or different sizes and masses of the spherical body 10 and the inner spherical object 22 could be used to allow for different levels of forgiveness when training different skill levels, and on various surface conditions that can influence the ball's inherent forgiveness.

There could be some optional versions of the ball, one with strategically placed weights, either permanently or temporarily installed, to allow further forgiveness level and action variation.

In one example, the raised lips 21 can be located at different spaced apart locations from each other, i.e., not defined by the first radius and the interface of the side cavities 18. And/or the raised lips 21 could be extend closer to or reduced further away from the optimal axis of rotation 40 through additive of subtractive methods. In other words, the position and distal end of one or more raised lip 21 could be deviated from what the first radius and/or cross sectional cut of the side cavities 18 would otherwise dictate. Thereby, the raised lips 21 could make it easier or more difficult for the inner spherical object 22 to roll into one of the side cavities 18 by the peripheral cavities narrowed or expanded, or the raised lips 21/guide rails that separate the aligned condition and the misaligned condition can be narrowed or moved further apart.

Another version could incorporate button batteries 32 and simple electronics to illuminate LED(s) 34 while the inner spherical object 22 is positioned at the center of the void, and the LED(s) would cease to illuminate once inner spherical object 22 falls into either of the outer voids. This could be achieved by placing the required components in positions so as not to disturb the overall center of gravity. A pair of electrically conductive parts with a central hole could be used to make up the apertures where inner spherical object 22 can roll within the center void area as desired. The inner spherical object 22 would be made of electrically conductive material and would complete the LED circuit while in the central position. The spherical body 10 could be stored with inner spherical object 22 positioned in one of the outer voids, to avoid draining the batteries when not in use. The pair of button batteries could be positioned at opposite poles to retain overall balance and could be easily replaced when needed.

A method of using the present invention may include the following. The putting training device 100 disclosed above could be used by an individual interested in improving their putting skill, it could be used in a training environment with a golf training professional, it could be used by golf professionals/athletes during practice/warmup prior to competition, it could also be used discretely in an office or otherwise professional setting. Various training programs and drills could be developed to maximize the effectiveness of training for skill improvement.

As used in this application, the term "about" or "approximately" refers to a range of values within plus or minus 10% of the specified number.

Under the rules of golf, a golf ball has a mass no more than 1.620 oz (45.93 grams), has a diameter not less than 1.680 in (42.67 mm).

One thing that should be understood is that incorrect and opposing open/closed face angles and swing paths can counteract somewhat, allowing a standard ball to roll straight, where the present invention has much less tolerance for. In addition, less-than-optimal vertical face angles can also influence the inherent sensitivity and action of the invention, as in popping the ball up off the surface too far, or not enough, or driving the ball down into the surface instead.

Finally, the action of the inner spherical object may sometimes be "bouncy" in nature, within the confines of the track, rather than smoothly rolling. This can vary. It can even give some audible feedback (rattling) which can relate to specific amounts and types of mishits that are still within the invention's margin of forgiveness. This can also cause the ball to wobble differently, which, with respect to the markings, can give additional visual feedback.

It should be understood, of course, that the foregoing relates to exemplary embodiments of the invention and that modifications may be made without departing from the spirit and scope of the invention as set forth in the following claims.

What is claimed is:

1. A training device, comprising:

a spherical body having an axis of rotation;

a track defining a track cavity within the spherical body, wherein the track curves approximately 360-degrees about the axis of rotation; and a mass dimensioned to ride along the track when the spherical body rolls about the axis of rotation and along a prime circumference, wherein the mass rolls off the track configured to deviate from an expected line of action when a force is applied obliquely relative to the prime circumference.

2. The training device of claim 1, further comprising:

one or more side cavities within the spherical body, one of the one or more side cavities to a side of the track so that when the mass rolls off the track into the one or more side cavities.

3. The training device of claim 2, further comprising:

wherein the one or more side cavities are two side cavities symmetrically disposed relative to the prime circumference.

4. The training device of claim 3, wherein the track is defined by a first curvature that curves approximately 360-degrees about the axis of rotation.

5. The training device of claim 4, wherein each side cavity communicates with the track cavity.

6. The training device of claim 5, further comprising:

two raised lips, each raised lip defined at an interface of the track cavity and each of the two side cavities, respectively.

7. The training device of claim 4, wherein the first curvature is curved entirely 360-degrees about the axis of rotation.

8. The training device of claim 4, wherein the track, the track cavity, and the two side cavities are defined by one or more inserts that are movable into and out of the spherical body.

9. The training device of claim 8, wherein the one or more inserts are two inserts that are symmetrical.

10. The training device of claim 9, wherein the two inserts are movable between a disengaged condition and an engaged condition trapping the mass within said cavities.

11. The training device of claim 1, further comprising:

a prime circumferential indicium along an outer surface of the spherical body.

12. The training device of claim 11, wherein the spherical body has both a weight and a diameter approximately similar to a regulation golf ball.

13. The training device of claim 12, wherein the applied force is imparted by a golf putter.

14. The training device of claim 13, wherein the mass is a spherical object.

15. The training device of claim 11, wherein the prime circumferential indicium visibly indicates a line of action.

16. The training device of claim 1, wherein the track is symmetrical relative to a prime circumference.

17. The training device of claim 1, wherein the training device is used for golf.

18. A training device, comprising:

a spherical body having an axis of rotation;

a track defining a track cavity within the spherical body, wherein the track is defined by a first curvature that curves 360-degrees about the axis of rotation;

a spherical object dimensioned to ride along the track when the spherical body rolls about the axis of rotation and along a prime circumference, wherein the spherical object rolls off the track when a force is applied obliquely relative to the prime circumference;

two side cavities within the spherical body, one side cavity on each side of the track so that when the spherical object rolls off the track into the one of the two side cavities, wherein the two side cavities and the track are symmetrically relative to the prime circumference, wherein each side cavity communicates with the track cavity;

a prime circumferential indicium along an outer surface of the spherical body, wherein the spherical body has both a weight and a diameter approximately similar to a regulation golf ball, wherein the prime circumferential indicium visibly indicates a line of action, whereby the training device is used for golf and the applied force is imparted by a golf putter.

19. The training device of claim 18, further comprising:

two raised lips, each raised lip defined at an interface of the track cavity and each of the two side cavities, respectively, wherein the track, the track cavity, and the two side cavities are defined by one or more inserts that are movable into and out of the spherical body.

* * * * *